US010733969B2

(12) United States Patent
Haberlah

(10) Patent No.: US 10,733,969 B2
(45) Date of Patent: Aug. 4, 2020

(54) PROTECTIVE ENCLOSURE FOR EFFECT DEVICES

(71) Applicant: Hans-Peter Wilfer, Markneukirchen (DE)

(72) Inventor: Torsten Haberlah, Bischberg (DE)

(73) Assignee: Hans-Peter Wilfer, Markneukirchen (DE)

( * ) Notice: Subject to any disclaimer, the term of this patent is extended or adjusted under 35 U.S.C. 154(b) by 0 days.

(21) Appl. No.: 16/186,171

(22) Filed: Nov. 9, 2018

(65) Prior Publication Data

US 2019/0139523 A1 May 9, 2019

(30) Foreign Application Priority Data

Nov. 9, 2017 (DE) ..... 10 2017 126 184

(51) Int. Cl.

*G10H 1/34* (2006.01)
*G10H 1/32* (2006.01)
*G10H 1/02* (2006.01)

(52) U.S. Cl.

CPC ..... *G10H 1/348* (2013.01); *G10H 1/02* (2013.01); *G10H 1/32* (2013.01)

(58) Field of Classification Search

CPC ..... G10H 1/348; G10H 1/02; G10H 1/32
USPC ..... 84/721, 746
See application file for complete search history.

(56) References Cited

U.S. PATENT DOCUMENTS 5,866,829 A * 2/1999 Pecoraro ..... G10H 1/32 84/177
5,981,862 A * 11/1999 Geier, Jr. ..... G10H 1/348 84/721
7,326,849 B2 * 2/2008 Adams ..... G10H 1/0066 84/743
8,536,438 B2 * 9/2013 Goto ..... F16M 13/005 84/746
8,957,297 B2 * 2/2015 Urry ..... G10H 1/06 84/721
9,495,947 B2 * 11/2016 Packouz ..... G10H 1/40
9,633,640 B1 * 4/2017 Lee ..... G10H 1/348
2011/0271821 A1 * 11/2011 McKinney ..... G10H 1/348 84/746
2012/0297963 A1 * 11/2012 Armstrong ..... G10H 1/0091 84/746
2013/0077319 A1 * 3/2013 Goto ..... F16M 13/005 362/296.01
2013/0298752 A1 * 11/2013 Juszkiewicz ..... G10H 1/34 84/746
2015/0161978 A1 * 6/2015 Packouz ..... G10H 1/40 84/746
2017/0025107 A1 * 1/2017 Packouz ..... G10H 1/348
2017/0025108 A1 * 1/2017 Packouz ..... G10H 1/42

* cited by examiner

*Primary Examiner* — Jeffrey Donels
(74) *Attorney, Agent, or Firm* — Scarinci Hollenbeck, LLC; Libby Babu Varghese

(57) ABSTRACT

A protective enclosure for an effect device includes a substantially rectangular shaped base portion and a substantially cuboid shaped upper portion. The base portion and upper portion communicate with one another and form a common receiving space to enclose an effect device. The base portion includes two opposite side walls, and each side wall has a respective opening to each provide access to the receiving space. An upper wall extends laterally across the base portion side walls, and a foot switch opening is disposed along the upper wall.

13 Claims, 5 Drawing Sheets

PROTECTIVE ENCLOSURE FOR EFFECT DEVICES

FIELD OF THE INVENTION

The disclosure relates to a protective enclosure to contain an effect device which influences the sound of electronic music instruments.

BACKGROUND

In the music industry, effect devices are typically electronic devices which are used to influence the sound of musical instruments, in particular electronic stringed instruments, such as electric guitars or electric basses. Such effect devices are usually switched on and off with the foot, and may have a variety of controls on the top of the effect device. In particular, during live concerts, certain effects are desired for different song passages and an artist will use their foot to turn different effects on or off, whereby there is a risk that the controls are accidentally adjusted by foot.

In addition, with live concerts, especially outdoor concerts, there is an additional risk of exposure to moisture and dirt by the effect devices. Intrusion of moisture or dirt into the interior of an effect device can damage or alter the operation of the effect device, for example, control elements of the effect device, including for example a potentiometer or switch. This may significantly affect the functionality of the effect device or controls.

What is desired is an enclosure to protect effect devices without limiting the operation or control of the effect devices.

BRIEF DESCRIPTION OF THE DRAWINGS

This disclosure is further described in the detailed description that follows, with reference to the drawings, in which.

DETAILED DESCRIPTION

Figure 1:
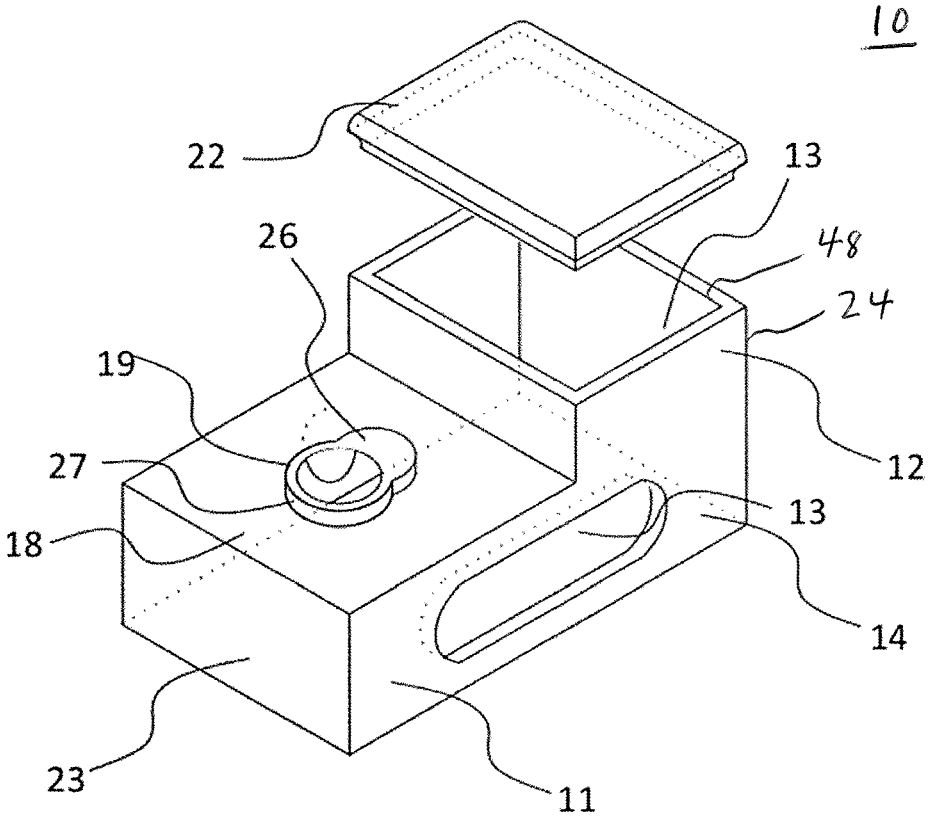
FIG. 1 is a perspective view of a protective enclosure for an effect device in accordance with an embodiment of the invention.

In the following description, the same reference numerals are used for the same and like parts.

FIG. 1 is a perspective view of a protective enclosure 10 according to an exemplary embodiment of the invention, wherein the protective enclosure 10 is formed by a rectangular base portion 11 and a cuboid-shaped upper portion 12, which together form a protective enclosure. In an exemplary embodiment, base portion 11 has a smaller internal volume in relation to upper portion 12 having a larger internal volume. Base portion 11 and upper portion 12 are each formed as a hollow body and both inner spaces are formed without partition connected to each other, so that a contiguous receiving space 13 is formed within the base portion 11 and the upper portion 12. In an exemplary embodiment, base portion 11 and upper portion 12 are integrally formed as a single structure.

Within the receiving space 13, a variety of commercially available effect devices are housed, for example for electric guitars or electric basses, wherein the housing of the effect device is received in the base portion 11 of the protective enclosure 10 and protruding controls (not shown) from the effect device are received in the upper portion 12.

The protective enclosure 10 formed by base portion 11 and upper portion 12 is bounded laterally by two oppositely disposed side walls 14, 15, and corresponding opposite disposed front wall 23 and back wall 24. The base portion 12 is further bound by upper wall 18 to side walls 14, 15.

Upper portion 12 includes opening 48, so that the protruding controls of an enclosed effect device (not shown) remain operable from above for the user. However, in order for the controls to be protected, the protective enclosure 10 in this embodiment comprises a lid 22 which can be snapped into the opening 48 of the top 12 from above but which, if the user wishes to operate the controls, can be opened.

Within the upper wall 18 of the base portion 11 is a foot switch opening 19, which allows the foot switch of an effects device to protrude protrude upward through switch opening 19 and thus remains operable for the user. In addition, reinforcing ring 27 circumscribes foot switch opening 19, and the reinforcing ring 27 has a height which is designed to protect a foot switch from lateral shocks as well as assist in trouble-free operation of the foot switch of an effects device.

Between the footswitch and the controls of an effect device, adjacent to the footswitch, are typically signal means, such as a light emitting diode, which signal to a user whether the effect device is in an on or off state. The protective enclosure 10 therefore has, adjacent to the reinforcing ring 27, a display window 26 which is located above the signal means to enable a user to view the signal means.

Figure 2:
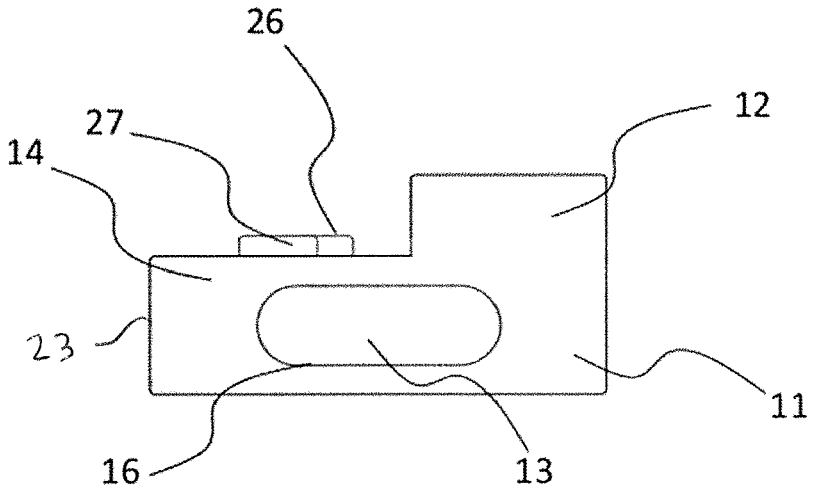
FIG. 2 is a right-side view of the protective enclosure of FIG. 1.

In FIG. 2 is a right-side view of the protective enclosure 10 according to the embodiment of FIG. 1 is shown. The side wall 14 includes opening 16, which is designed as a slot, so that one or more signal output sockets of the effects device remain connectable external to the protective enclosure 10. In an exemplary embodiment, opening 16 is located centrally along side wall 14 at a location in which many conventional effects devices locate their respective signal output sockets. Furthermore, in FIG. 2, the reinforcing ring 27 and the display window 26 are shown laterally. The display window 26 has the same height as the reinforcing ring 27 in an exemplary embodiment.

Figure 3:
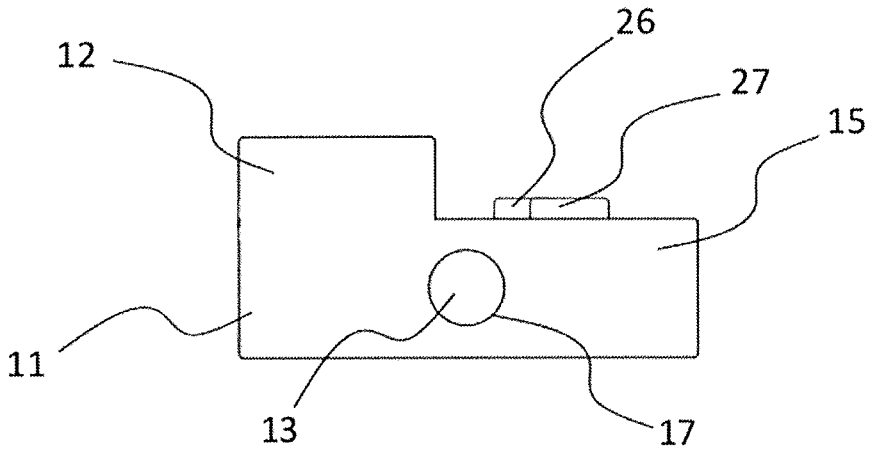
FIG. 3 is a left-side view of the protective enclosure of FIG. 1.

In FIG. 3 is a left-side view of the second side wall 15 is shown, which is opposite to the first side wall 14. In an exemplary embodiment, the side wall 15 has a centrally aligned opening 17 at a location for the signal input jack of many conventional effects devices. It can be understood that opening 17 can be in a shape other than round, but since most effect devices have only a signal input jack on this side of the effect device housing, a slot shaped opening 17 on the side wall 15 may be superfluous.

Figure 4:
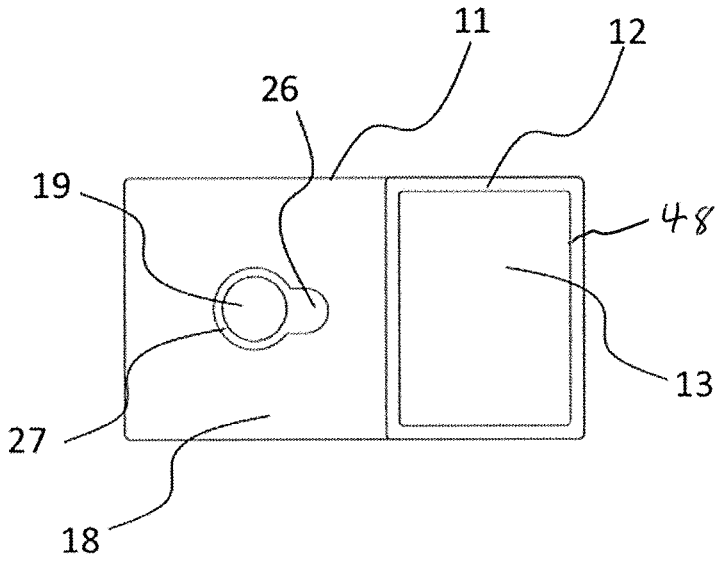
FIG. 4 is a top plan view of the protective enclosure of FIG. 1.

In FIG. 4 is a plan view of the protective enclosure 10 according to the embodiment of FIG. 1 is shown. Upper portion 12 is open at the top by opening 48 for access to the receiving space 13, in which operating elements of the effect device can be accommodated at this point, is shown from above. Circular foot switch opening 19 is shown disposed along upper wall 18. The reinforcing ring 27 circumscribes the foot switch opening 19 and also is integrated with display window 26 having a smaller diameter than the foot switch opening 19.

Figure 5:
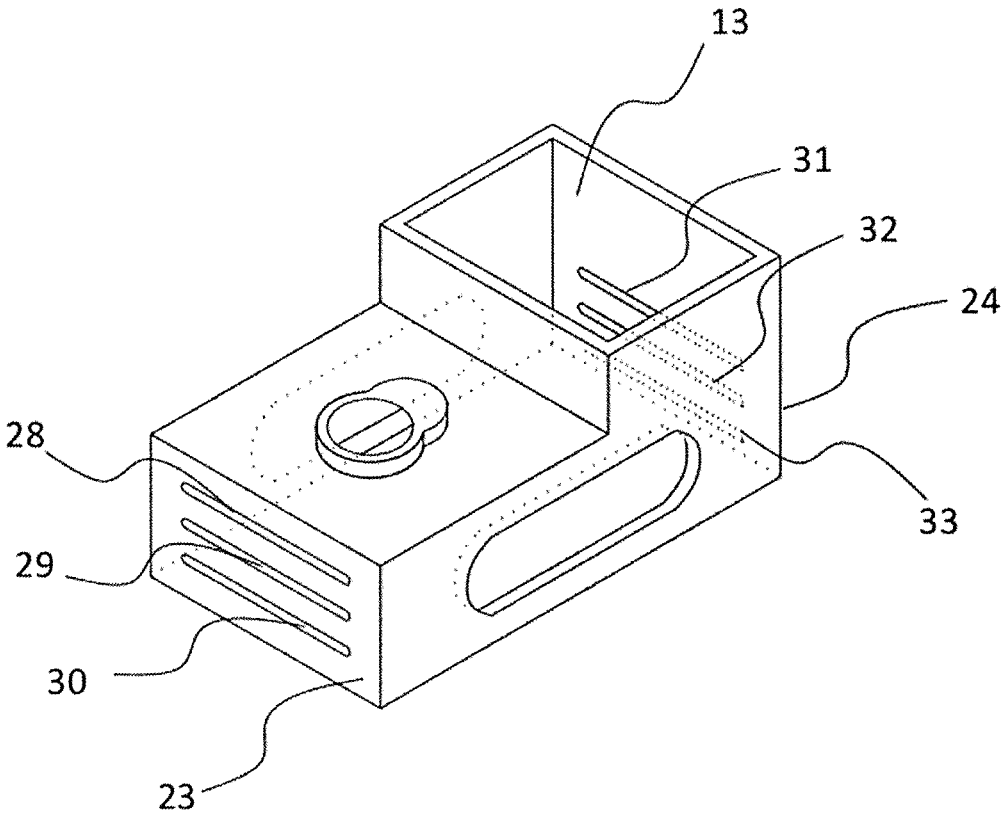
FIG. 5 is a perspective view of a protective enclosure for an effect device in accordance with an exemplary embodiment of the invention.

FIG. 5 is a perspective view of a protective enclosure 10 in accordance with an exemplary embodiment. Three front wall ventilation openings 28, 29, 30 and three rear wall ventilation openings 31, 32, 33 are shown on corresponding front wall 23 and rear wall 24, which allow air to pass through the protective enclosure. The number and shape of the ventilation openings 28-33 can vary. In this embodiment, the ventilation openings are slit-shaped along the front wall 23 and back wall 24, respectively. Ventilation openings 28-33 allow excess heat generated by electronic components located in the effect device to be ventilated outside of protective enclosure 10 to prevent overheating.

Figure 6:
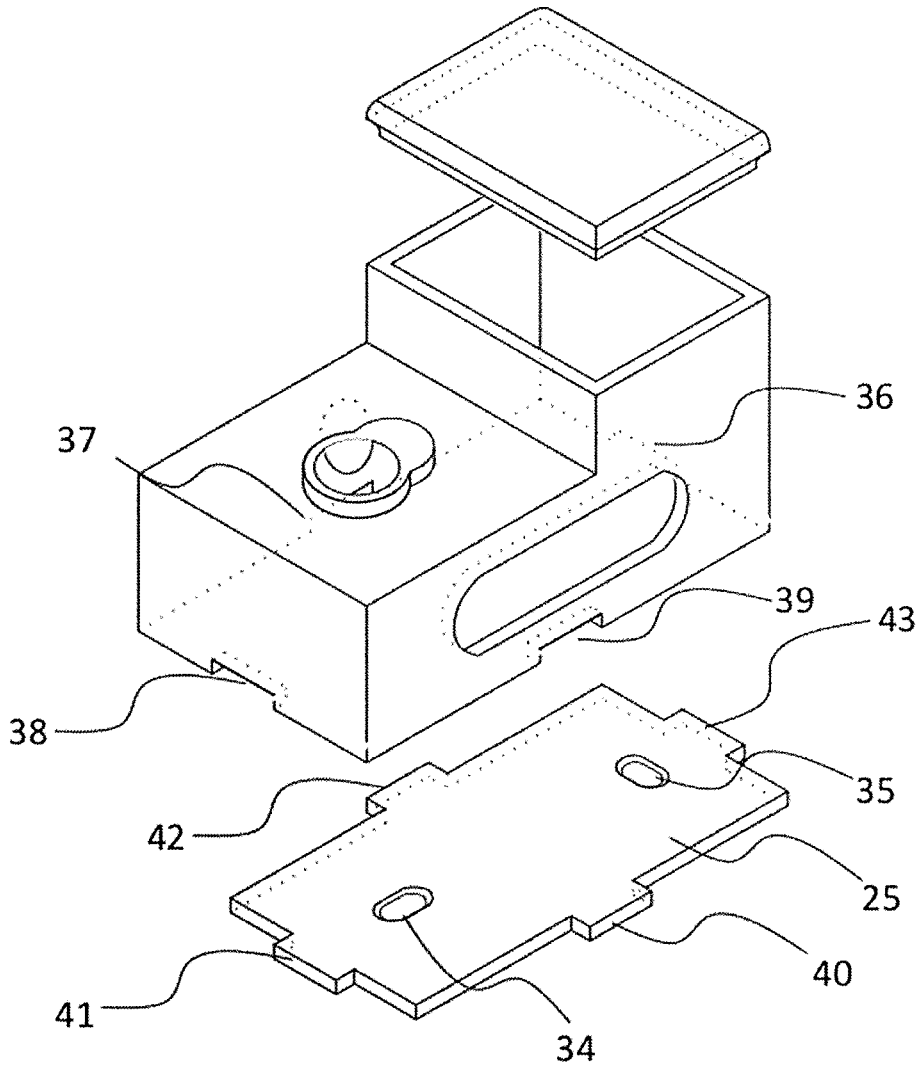
FIG. 6 is a perspective view of a protective enclosure for an effect device in accordance with an exemplary embodiment of the invention.
Figure 7:
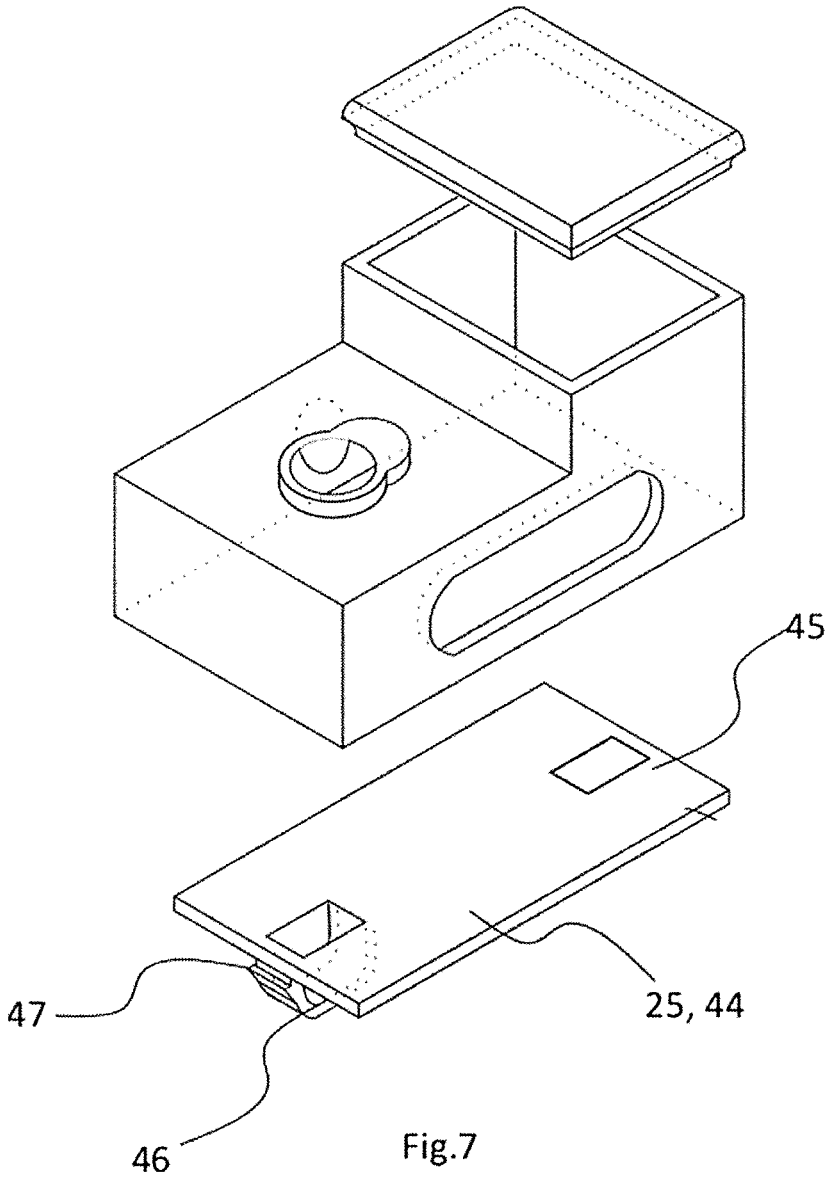
FIG. 7 is a perspective view a protective enclosure for an effect device in accordance with an exemplary embodiment of the invention.

FIG. 6 is a perspective view of the protective enclosure 10 according to an exemplary embodiment. In this embodiment, a bottom cover plate 25 is shown with attachment slots 34, 35. Attachment slots 34, 35 are positioned such that the bottom cover plate 25 can be attached to an effect device holder with countersunk screws in an exemplary embodiment. The bottom cover plate 25 can alternatively be connected via other desired fasteners or fastening means, for example adhesive, adhesive strips, hook and loop fasteners, or the like, to desired effect device holders. Other connection options are conceivable, such as fasteners on the bottom plate 25, which engage in complementary detent recesses on an effect device holders (pedal boards), such as what is described in German Patent Application DE 102017125822.

The protective enclosure 10 includes recesses 36, 37, 38 and 39 along the lower edges of the two side walls 14, 15, the front wall 23 and the rear wall 24 respectively. On the sides of the bottom plate 25 are lateral protrusions 40, 41, 42 and 43, which are configured to engage in the recesses 36, 37, 38 and 39 and to prevent movement of bottom plate 25 relative to the protective enclosure 10.

The invention claimed is:

1. A protective enclosure for an effect device, comprising:

a substantially rectangular shaped base portion and a substantially cuboid shaped upper portion, wherein the base portion and upper portion communicate with one another and form a common receiving space configured and adapted to enclose an effect device;

wherein the base portion comprises two opposite side walls, each side wall having a respective opening to each provide access to said receiving space; and wherein an upper wall extends laterally across the base portion side walls, and a foot switch opening is disposed along the upper wall.

2. The protective enclosure according to claim 1, wherein the upper portion is configured and adapted to receive and enclose operating elements of an effect device.

3. The protective enclosure according to claim 1, wherein the upper portion is formed of a transparent material.

4. The protective enclosure according to claim 1, wherein a portion of the base portion is formed of a transparent material.

5. The protective enclosure according to claim 1, wherein the base portion is formed of a transparent material.

6. The protective enclosure according to claim 1, wherein the base portion and the upper portion are integrally formed.

7. The protective enclosure according to claim 1, wherein the upper portion further comprises a removable cover.

8. The protective enclosure according to claim 1, wherein at least a portion of the upper portion is constructed of material selected from the group consisting of transparent plastic, silicone, thermoplastic, urethane (TPU), silicone TPU and polycarbonate.

9. The protective enclosure according to claim 1, wherein at least a portion of the base portion is constructed of material selected from the group consisting of transparent plastic, silicone, thermoplastic urethane (TPU), silicone TPU and polycarbonate.

10. The protective enclosure according to claim 1, wherein a rear wall is provided, which forms a common rear wall of the base portion and the upper portion.

11. The protective enclosure according to claim 1, wherein a bottom plate is provided which is latchably connectable to a lower edge region of the base portion.

12. The protective enclosure according to claim 1, wherein a display window is disposed along the upper wall and adjacent to the foot switch opening.

13. The protective enclosure according to claim 1, wherein a reinforcing ring circumscribes the foot switch opening along the upper wall.

* * * * *